US010113825B2

(12) United States Patent
Bailey

(10) Patent No.: US 10,113,825 B2
(45) Date of Patent: Oct. 30, 2018

(54) SYSTEMS AND METHODS FOR ATTACHING A SECONDARY FIREARM TO A PRIMARY FIREARM

(71) Applicant: KUDZU ARMS, LLC, Hogansville, GA (US)

(72) Inventor: Christopher G. Bailey, Hogansville, GA (US)

(73) Assignee: Kudzu Arms, LLC, Hogansville, GA (US)

( * ) Notice: Subject to any disclaimer, the term of this patent is extended or adjusted under 35 U.S.C. 154(b) by 0 days.

(21) Appl. No.: 15/588,798

(22) Filed: May 8, 2017

(65) Prior Publication Data

US 2017/0328665 A1 Nov. 16, 2017

Related U.S. Application Data

(60) Provisional application No. 62/334,081, filed on May 10, 2016.

(51) Int. Cl.

| | |
|---|---|
| ***F41F 1/08*** | (2006.01) |
| ***F41A 21/10*** | (2006.01) |
| ***F41A 21/48*** | (2006.01) |
| ***F41A 3/68*** | (2006.01) |
| ***F41C 27/06*** | (2006.01) |
| ***F41A 19/18*** | (2006.01) |
| *F41A 3/66* | (2006.01) |
| *F41A 21/06* | (2006.01) |

(52) U.S. Cl.

CPC ..... *F41A 21/10* (2013.01); *F41A 3/68* (2013.01); *F41A 19/18* (2013.01); *F41A 21/484* (2013.01); *F41C 27/06* (2013.01); *F41F 1/08* (2013.01); *F41A 3/66* (2013.01); *F41A 21/06* (2013.01)

(58) Field of Classification Search

CPC ..... F41A 3/68; F41A 19/18; F41A 19/183; F41A 19/68; F41A 21/06; F41C 27/06; F41F 1/08

USPC ..... 42/85, 90, 105, 106; 89/1.41, 126

See application file for complete search history.

(56) References Cited

U.S. PATENT DOCUMENTS

| | | | | |
|---|---|---|---|---|
| 2,075,704 A | | 3/1937 | Crosby | |
| 3,279,114 A | * | 10/1966 | Lewis | F41C 27/06 42/105 |
| 3,408,761 A | | 11/1968 | Silsby | |
| 3,507,067 A | * | 4/1970 | Into | F41A 19/40 42/10 |

(Continued)

FOREIGN PATENT DOCUMENTS

WO 2007/091236 A1 8/2007

*Primary Examiner* — Stephen Johnson
*Assistant Examiner* — Benjamin S Gomberg
(74) *Attorney, Agent, or Firm* — Eversheds Sutherland (US) LLP

(57) ABSTRACT

A secondary firearm with a rail mount attachable to a rail assembly of a primary firearm is disclosed. The secondary firearm comprises a body having at least one retaining pin hole and a bolt stop hole and a housing disposed about the body. The housing comprises at least one retaining pin aperture and/or a bolt stop aperture. The secondary firearm also includes at least one fastener disposed within at least one of the at least one retaining pin aperture and the at least one retaining pin hole and/or the bolt stop aperture and the bolt stop hole to fasten the housing to the body.

13 Claims, 5 Drawing Sheets

(56) References Cited

U.S. PATENT DOCUMENTS 3,641,691 A * 2/1972 Ellis ..... F41C 27/06 42/105
3,782,021 A 1/1974 Atchisson
4,195,432 A * 4/1980 Hickman ..... F41A 21/08 42/106
4,689,911 A * 9/1987 White ..... F41A 19/39 42/1.06
5,198,600 A 3/1993 E'Nama
5,628,137 A * 5/1997 Cortese ..... F41C 27/06 42/105
6,247,995 B1 * 6/2001 Bryan ..... A23G 3/366 124/74
6,250,194 B1 * 6/2001 Brandl ..... F41A 19/18 42/71.01
6,418,655 B1 * 7/2002 Kay ..... F41A 3/46 42/70.08
6,481,145 B2 * 11/2002 Weichert ..... F41C 27/06 42/105
6,532,947 B1 * 3/2003 Rosa ..... F42B 12/40 124/56
6,829,858 B2 * 12/2004 Gablowski ..... F41C 27/06 42/105
D530,774 S 10/2006 Oscarsson et al.
7,409,912 B2 * 8/2008 Cerovic ..... F41H 13/0018 102/502
7,634,959 B2 12/2009 Frickey
7,891,130 B2 * 2/2011 Griffin ..... F41C 27/06 42/105
8,020,334 B2 * 9/2011 Delmonico ..... F41C 27/00 42/105
8,281,512 B2 * 10/2012 Lara ..... F41C 27/00 224/198
8,371,056 B1 * 2/2013 Baker ..... F41G 11/003 42/106
8,393,107 B2 * 3/2013 Brown ..... F41C 7/00 42/105
8,528,246 B2 9/2013 Telles
8,578,644 B1 11/2013 Oquin et al.
8,739,452 B1 * 6/2014 Calvert ..... F41G 11/004 42/106
8,763,295 B2 * 7/2014 Trimble ..... F41A 23/02 42/72
8,857,096 B2 * 10/2014 McClintock ..... F41G 11/003 42/72
8,898,948 B1 12/2014 Gaddini et al.
8,943,729 B2 * 2/2015 Williams ..... F41C 23/16 42/106
9,022,255 B1 5/2015 Calvert
9,068,801 B1 6/2015 Stecher et al.
9,279,638 B2 3/2016 Adair et al.
9,441,899 B2 * 9/2016 Micklethwaite ..... F41A 19/18
2005/0188593 A1 * 9/2005 Cerovic ..... F41A 19/58 42/77
2015/0300786 A1 10/2015 Downing et al.
2016/0153744 A1 * 6/2016 Teetzel ..... F41C 27/06 42/105

* cited by examiner

SYSTEMS AND METHODS FOR ATTACHING A SECONDARY FIREARM TO A PRIMARY FIREARM

CROSS-REFERENCE TO RELATED APPLICATIONS

The disclosure claims priority to and the benefit of U.S. provisional patent application No. 62/334,081, filed May 10, 2016, which is incorporated by reference herein in its entirety.

FIELD OF THE DISCLOSURE

The disclosure generally relates to firearms and more particularly relates to systems and methods for attaching a secondary firearm to a primary firearm.

BACKGROUND

The attachment of a secondary firearm to a primary firearm adds to the versatility of the firearm. However, due to the offset attachment of the secondary firearm to the primary firearm, a large amount of torque is exerted on the secondary firearm when discharged. Accordingly, there is a need for a system to attach the secondary firearm to the primary firearm that ensures the structural integrity of the secondary firearm when discharged.

SUMMARY

Some or all of the above needs and/or problems may be addressed by certain embodiments of the secondary firearm disclosed herein. According to an embodiment, the secondary firearm includes a rail mount attachable to a rail assembly of a primary firearm. The secondary firearm comprises a body having at least one retaining pin hole and a bolt stop hole and a housing disposed about the body. The housing comprises at least one retaining pin aperture and/or a bolt stop aperture. The secondary firearm also includes at least one fastener disposed within at least one of the at least one retaining pin aperture and the at least one retaining pin hole and/or the bolt stop aperture and the bolt stop hole to fasten the housing to the body.

Other features and aspects of the disclosure will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
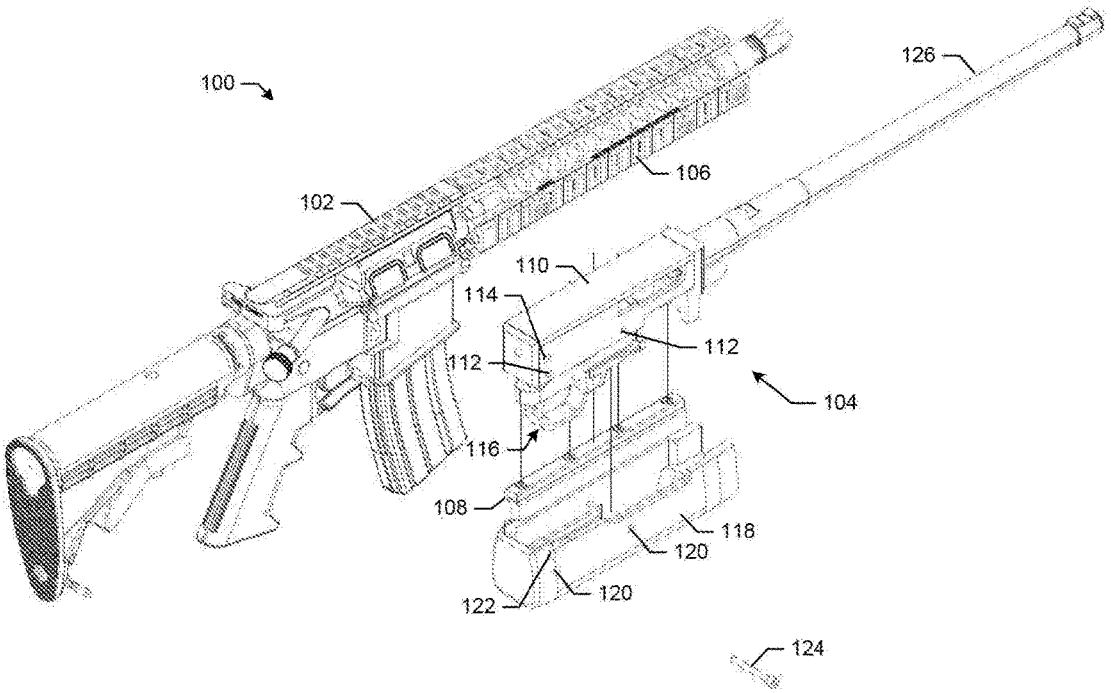
FIG. 1 depicts an upper perspective view of a firearm assembly in accordance with one or more embodiments of the disclosure.
Figure 2:
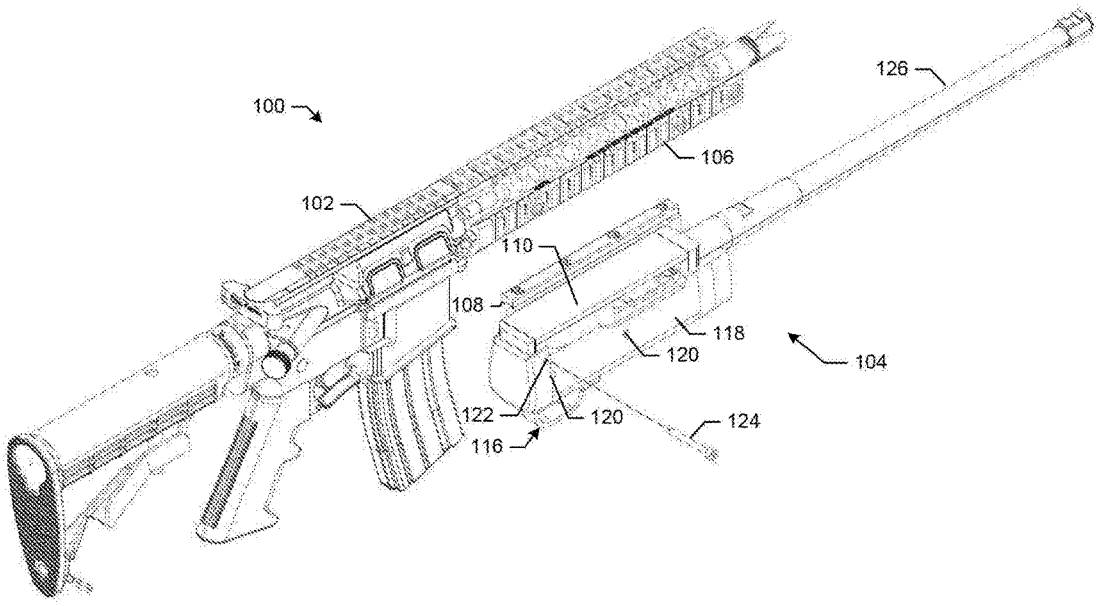
FIG. 2 depicts an upper perspective view of a firearm assembly in accordance with one or more embodiments of the disclosure.
Figure 3:
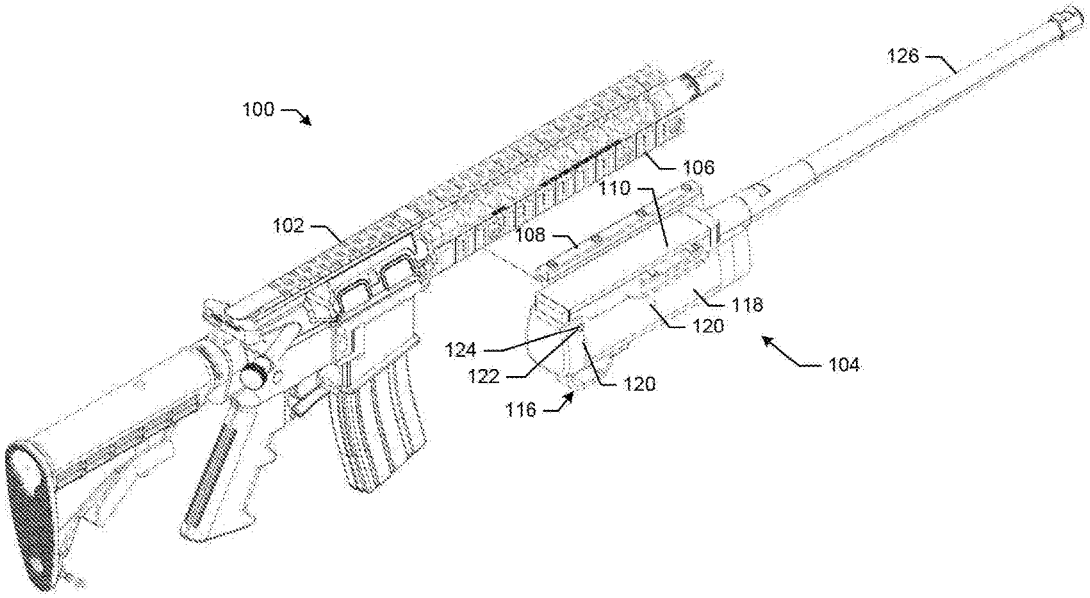
FIG. 3 depicts an upper perspective view of a firearm assembly in accordance with one or more embodiments of the disclosure.
Figure 4:
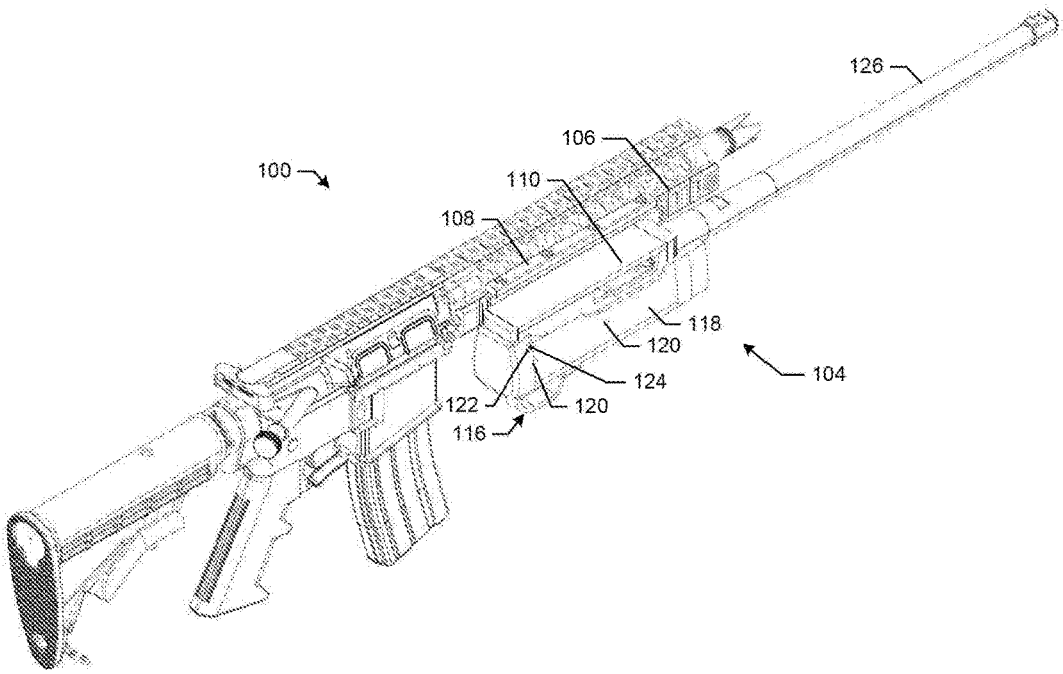
FIG. 4 depicts an upper perspective view of a firearm assembly in accordance with one or more embodiments of the disclosure.

Described below are embodiments of systems and methods for attaching a secondary firearm to a primary firearm. The primary firearm may be a conventional firearm. For example, the primary firearm may be an M-16 style rifle, an AR-15 style rifle, an AR-10 style rifle, or an M-4 style rifle, among others. The primary firearm may be any firearm that includes an accessory system or any firearm that can be fitted with a forearm/handguard mounting rail attachment system. The secondary firearm may be a conventional firearm. In some instances, the secondary firearm may be a .22 caliber firearm. The secondary firearm may be any caliber firearm.

Generally speaking, the firearm assembly includes a primary firearm and a secondary firearm. The primary firearm includes a rail assembly or any forearm/handguard that accepts rails or the like. The secondary firearm includes a rail mount attachable to the rail assembly of the primary firearm. In addition, the secondary firearm comprises a body having at least one retaining pin hole and a bolt stop hole, a trigger group positionable within the body, and a housing disposed about the body. The housing of the secondary firearm is absent a shoulder-abutting stock or hand grip extending therefrom. That is, in some instances, the secondary firearm does not include a shoulder stock.

In a typical secondary firearm, a bolt stop pin (or bolt buffer) is disposed within the bolt stop hole in the body. The bolt stop pin is maintained in place via the housing (e.g., stock) disposed around the bolt stop hole. Similarly, in a typical secondary firearm, a retaining pin (or trigger group retaining pin) is disposed within the at least one retaining pin hole. The retaining pin is maintained in place via the housing (e.g., stock) disposed around the bolt stop hole. In some instances, the trigger group comprises a plurality of retaining pins.

In the present disclosure, the housing includes at least one retaining pin aperture and/or a bolt stop aperture. The secondary firearm also include at least one fastener disposed within one of the retaining pin aperture and the retaining pin hole and/or the bolt stop aperture and the bolt stop hole to fasten the housing to the body, as well as any stock attachment device incorporated as part of the secondary firearm.

In some instances, the fastener acts as a retaining pin and a connection between the body and the housing. In other instances, the fastener acts as a bolt stop and a connection between the body and the housing. In this manner, by replacing the retaining pin and/or the bolt stop with a fastener (such as a bolt stop screw or a retaining pin screw) the body and housing are secured together at an additional point, which provides a more secure connection between the body and housing to tolerate the forces and torques exerted on the secondary firearm when discharged.

The rail mount is attached to the housing. Any attachment means may be used to attached the rail mount to the housing.

In other instances, the rail mount is attached to a barrel of the secondary firearm. The rail mount may be disposed at any location on the secondary firearm. The rail mount may be any attachment mechanism for attaching the secondary firearm to the primary firearm or incorporated into the forearm/handguard of the primary firearm.

In some instances, a kit is provided for modifying a primary firearm to include a secondary firearm attached thereto. For example, the kit may enable the mounting the secondary firearm to a rail assembly of the primary firearm. The secondary firearm includes a body comprising at least one retaining pin hole and a bolt stop hole. A trigger group is positionable within the body. The kit includes a housing adapted to be disposed about the body. The housing comprises at least one retaining pin aperture, a bolt stop aperture, and a rail mount attached thereto. The housing is absent a shoulder-abutting stock. The kit also includes at least one fastener shaped to be disposed within one of the at least one retaining pin aperture and the at least one retaining pin hole and/or the bolt stop aperture and the bolt stop hole to fasten the housing to the body. The kit includes instructions for disposing the housing about the body, disposing the at least one fastener within the at least one retaining pin aperture and the at least one retaining pin hole and/or the bolt stop aperture and the bolt stop hole, and mounting the secondary firearm to the rail assembly of the primary firearm, as well as incorporating any stock attachment device that is part of the secondary firearm.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

FIGS. 1-4 depict a firearm assembly 100. The firearm assembly 100 includes a primary firearm 102 and a secondary firearm 104. The primary firearm 102 may be a conventional firearm. For example, the primary firearm 102 may be an M-16 style rifle, an AR-15 style rifle, an AR-10 style rifle, or an M-4 style rifle, among others. Similarly, the secondary firearm 104 may be a conventional firearm. In some instances, the secondary firearm 104 may be a .22 caliber firearm. The secondary firearm 104 may be any caliber firearm.

The primary firearm 102 includes a rail assembly 106. The rail assembly 106 may be any type of rail assembly, including Picatinny rails, M-Lok rails, KeyMod rails, a combination thereof, or the like. The secondary firearm 104 includes a rail mount 108. The rail mount 108 is attachable to the rail assembly 106 of the primary firearm 102. The rail mount 108 may be any clamping or retaining device. In this manner, the secondary firearm 104 is attached to the primary firearm 102 by way of the rail assembly 106 and rail mount 108.

In addition, the secondary firearm 104 comprises a body 110. The body 110 includes at least one retaining pin hole 112. The body 110 also includes a bolt stop hole 114. A trigger group 116 is positionable within the body 110.

A housing 118 is disposed about the body 110. The housing 118 is absent a shoulder-abutting stock or hand grip extending therefrom. In this manner, the housing 118 acts as a casing about the body 110 to maintain the various pins, bolts, etc. within the body 110. The housing 118 includes at least one retaining pin aperture 120 and a bolt stop aperture 122. The trigger group 116 comprises a plurality of retaining pins. The retaining pins may be disposed within the retaining pin holes 112 in the body 110. In some instances, the housing 118 surrounds the body 110 and maintains at least some of the retaining pins within the body 110. In addition, secondary firearm 104 includes a bolt stop disposed within the bolt stop hole 114 in the body 110.

The secondary firearm 104 also include at least one fastener 124. In certain embodiments, the fastener 124 may replace one of the retaining pins or bolt stop. For example, in some instances, the fastener 124 may be disposed within the retaining pin aperture 120 and the retaining pin hole 112 to fasten the housing 118 to the body 110. In this manner, the fastener 124 acts as a retaining pin screw. That is, the fastener 124 acts as a retaining pin and a connection between the body 110 and the housing 118. In other instances, the fastener 124 may be disposed within the bolt stop aperture 122 and the bolt stop hole 114 to fasten the housing 118 to the body 110. In this manner, the fastener 124 acts as a bolt stop screw. That is, the fastener 124 acts as a bolt stop and a connection between the body 110 and the housing 118.

In this manner, by replacing the retaining pin and/or the bolt stop with a fastener (such as a bolt stop screw or a retaining pin screw) the body 110 and housing 118 are secured together at an additional point, which provides a more secure connection between the body 110 and housing 118 to tolerate the forces and torques exerted on the secondary firearm 104 when discharged.

In some instances, the rail mount 108 is attached to the housing 118. The rail mount 108 may be screwed, adhered, etc. to the housing 118. In some instances, the rail mount 108 may be integrally formed with the housing 118. That is, the rail mount 108 and the housing 118 may be a single, unitary piece. In other instances, the rail mount 108 is attached to a barrel 126 of the secondary firearm 104. The rail mount 108 may be disposed at any location on the secondary firearm 104. The rail mount 108 may be any attachment mechanism for attaching the secondary firearm 104 to the primary firearm 102.

Figure 5:
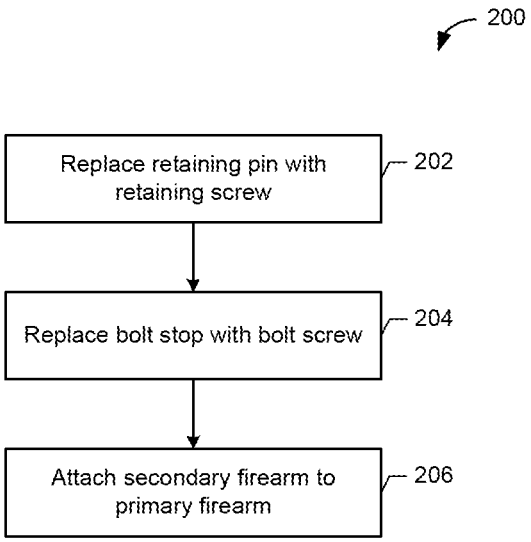
FIG. 5 is a flow diagram depicting an illustrative method for attaching a secondary firearm to a primary firearm in accordance with one or more embodiments of the disclosure.

FIG. 5 is a flow diagram depicting an illustrative method 200 for attaching the secondary firearm 104 to the primary firearm 102 in accordance with one or more embodiments of the disclosure. At block 202 of method 200, the retaining pin may be replaced by a retaining pin screw. Alternatively, at block 204, the bolt stop may be replaced with a bolt stop screw. Next, at block 206, the secondary firearm 104 may be attached to the primary firearm 102. The steps described in blocks 202-206 of method 200 may be performed in any order. Moreover, certain steps may be omitted, while other steps may be added.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A secondary firearm with a rail mount attachable to a rail assembly of a primary firearm, wherein the secondary firearm comprises:

a body comprising at least one trigger group retaining pin hole and a bolt stop hole;

a housing disposed about the body, wherein the housing comprises at least one trigger group retaining pin aperture and/or a bolt stop aperture; and at least one fastener disposed within at least one of the at least one trigger group retaining pin aperture and the at least one trigger group retaining pin hole and/or the bolt stop aperture and the bolt stop hole to fasten the housing to the body, wherein the at least one fastener acts as a trigger group retaining pin and fastens the body and the housing together, or wherein the at least one fastener acts as a bolt stop and fastens the body and the housing together.

2. The secondary firearm of claim 1, further comprising a trigger group positionable within the body.

3. The secondary firearm of claim 1, wherein the rail mount is attached to the housing.

4. The secondary firearm of claim 1, wherein the rail mount is attached to a barrel of the secondary firearm.

5. The secondary firearm of claim 1, wherein the secondary firearm comprises a .22 caliber firearm.

6. A firearm assembly, comprising:

a primary firearm with a rail assembly; and a secondary firearm with a rail mount attachable to the rail assembly of the primary firearm, wherein the secondary firearm comprises:

a body comprising at least one trigger group retaining pin hole and a bolt stop hole, a housing disposed about the body, wherein the housing comprises at least one trigger group retaining pin aperture and/or a bolt stop aperture, and at least one fastener disposed within at least one of the at least one trigger group retaining pin aperture and the at least one trigger group retaining pin hole and/or the bolt stop aperture and the bolt stop hole to fasten the housing to the body, wherein the at least one fastener acts as a trigger group retaining pin and fastens the body and the housing together, or wherein the at least one fastener acts as a boll stop and fastens the body and the housing together.

7. The assembly of claim 6, further comprising a trigger group positionable within the body.

8. The assembly of claim 6, wherein the rail mount is attached to the housing.

9. The assembly of claim 6, wherein the rail mount is attached to a barrel of the secondary firearm.

10. The assembly of claim 6, wherein the secondary firearm comprises a .22 caliber firearm.

11. A kit for mounting a secondary firearm to a rail assembly of a primary firearm, wherein the secondary firearm comprises a body comprising at least one trigger group retaining pin hole and a bolt stop hole, wherein the kit comprises:

a housing adapted to be disposed about the body, wherein the housing comprises at least one trigger group retaining pin aperture and/or a bolt stop aperture, wherein the housing is absent a shoulder-abutting stock; and at least one fastener shaped to be disposed within at least one of the at least one trigger group retaining pin aperture and the at least one trigger group retaining pin hole and/or the bolt stop aperture and the bolt stop hole to fasten the housing to the body, wherein the at least one fastener acts as a trigger group retaining pin and fastens the body and the housing together, or wherein the at least one fastener acts as a bolt stop and fastens the body and the housing together.

12. The kit of claim 11, further comprising a rail mount attachable to the housing.

13. The kit of claim 11, further comprising instructions for disposing the housing about the body, disposing the at least one fastener within the at least one trigger group retaining pin aperture and the at least one trigger group retaining pin hole and/or the bolt stop aperture and the bolt stop hole, and mounting the secondary firearm to the rail assembly of the primary firearm.

* * * * *